US006805354B2

(12) United States Patent
Martin et al.

(10) Patent No.: US 6,805,354 B2
(45) Date of Patent: Oct. 19, 2004

(54) ELECTRONIC DART GOLF GAME

(75) Inventors: John R. Martin, Rockford, IL (US); Ryan C. Jones, Loves Park, IL (US); Patrick G. Rice, Loves Park, IL (US); Christopher M. Walker, Machesney Park, IL (US); Timothy J. Ward, Rockford, IL (US)

(73) Assignee: Arachnid, Inc., Rockford, IL (US)

( * ) Notice: Subject to any disclaimer, the term of this patent is extended or adjusted under 35 U.S.C. 154(b) by 0 days.

(21) Appl. No.: 10/145,259

(22) Filed: May 14, 2002

(65) Prior Publication Data

US 2002/0171204 A1 Nov. 21, 2002

Related U.S. Application Data

(60) Provisional application No. 60/292,710, filed on May 21, 2001.

(51) Int. Cl.[7] ..... F41J 7/04
(52) U.S. Cl. ..... 273/378; 463/5
(58) Field of Search ..... 273/371, 378, 273/379, 317.1; 463/1, 2, 5, 7, 30, 31, 40, 43, 53

(56) References Cited

U.S. PATENT DOCUMENTS 3,697,073 A * 10/1972 Dooley ..... 273/358
4,057,251 A 11/1977 Jones et al.
4,561,660 A 12/1985 Zammuto
4,586,716 A 5/1986 Brejcha et al.
4,824,121 A 4/1989 Beall et al.
5,020,806 A 6/1991 Martin
5,197,743 A 3/1993 Hanson, Jr.
5,401,033 A 3/1995 Lychock, Jr.
5,553,850 A 9/1996 Savu et al.
5,558,337 A 9/1996 Frank, III
5,642,886 A * 7/1997 Yancey, Jr. ..... 273/408
5,975,530 A 11/1999 Gary
6,462,720 B1 10/2002 Yamashita et al.

* cited by examiner

*Primary Examiner*—Kim Nguyen
(74) *Attorney, Agent, or Firm*—McAndrews, Held & Malloy, Ltd.

(57) ABSTRACT

A system for a dart-based golf game on an electronic dart game machine has been developed that includes at least one electronic dart board having distinct scoring segments, a CPU electrically connected to the electronic dart board, and a video display electrically connected to the CPU. The CPU displays game mode graphics on the video display, including a golf course hole graphic having a virtual ball and a hole, and a power meter having a moving element. The CPU correlates an instantaneous movement of said moving element at an instant of the dart contact with a movement of the virtual ball on the golf course hole graphic.

42 Claims, 5 Drawing Sheets

ELECTRONIC DART GOLF GAME

RELATED APPLICATIONS

This application relates to and claims priority benefits from U.S. Provisional Patent Application No. 60/292,710 entitled "Computerized Dart Game," filed May 21, 2001, which is incorporated by reference herein in its entirety.

BACKGROUND OF THE INVENTION

Embodiments of the present invention relate to a dart game that may be played on an electronic dart game machine, and more particularly to an electronic dart golf game that may be played on an electronic dart game machine.

For many years, dart players have enjoyed the automatic handling of dart game scoring in electronic dart game machines. Electronic dart games and associated electronics are disclosed, for example, in U.S. Pat. No. 5,401,033, entitled "Dart Game With Random Target Number Generator," issued to Lychock. Jr. ("the '033 patent"); U.S. Pat. No. 4,057,251, entitled "Dart Game With Apertured Target Plates Resiliently Mounted," issued to Jones et al ("the '251 patent"), U.S. Pat. No. 4,561,660, entitled "Dart Machine With Electronic Matrix," issued to Zammuto ("the '660 patent"); and U.S. Pat. No. 4,586,516, entitled "Double Bullseye For Dart Game," issued to Brejcha et al ("the '516 patent"). The disclosures of the '033, '251, '660 and '516 patents are herein incorporated by reference in their entireties.

Typically, an electronic dart game machine includes an internal central processing unit (CPU) that controls the user interface for game selection and feedback during game play. The CPU within an electronic dart game machine typically keeps track of player scores and game parameters. That is, after the CPU receives information from the dart board playing surface (e.g., the point where the dart hit, such as a distinct scoring segment such as a bullseye, or "triple 20") the CPU may send information to a display unit so that the player may see his/her score.

For the CPU to determine the point where a dart hit, and consequently a player's score, the dart board playing surface, i.e., the dart board, is typically connected to a contact detector that is divided into various segments. For example, a distinct segment is typically assigned to (and positioned behind) the bullseye. Additionally, each distinct scoring segment of the dart board playing surface (e.g., single 20, double 20, triple 20, single 18, double 18, triple 18, etc.) is associated with a distinct segment of the contact detector. For example, if a player's thrown dart hits or contacts a triple 15 area on the dart board playing surface, the contact from the throw is detected by the segment of the contact detector associated with the triple 15 area. This information is communicated to the CPU, typically by wires. The CPU includes programs that link this communicated information to a particular score, depending on the game being played. For example, if "cricket" is played, the CPU would score three marks of "15" for the player who threw the dart that hit the "triple 15." Thus, upon determination or computation of a particular score, the CPU sends information to a display unit so that the player(s) can see the score(s).

Many dart game machines employ the use of a video monitor, such as a television, computer screen and the like, to provide user interface feedback. That is, video monitors may display player scores, the type of game being played, various parameters of the game, and the like. U.S. Pat. No. 4,824,121, issued to Beall et al. ("the '121 patent"), describes how a typical electronic dart board game machine with a video monitor functions. The Beall patent is herein incorporated by reference in its entirety.

Additionally, U.S. Pat. No. 5,020,806 entitled "Multiple Target Electronic Dart Game," issued to Martin ("the '806 patent") discloses a multiple dart board electronic dart game having a shared microprocessor that monitors and services operation of each dart board. The '806 patent is herein incorporated by reference in its entirety. The graphical display of the '806 patent operates under the control of the microprocessor and may show player scores in a split screen display or in a single display.

While many electronic dart game machines include video displays, typical video displays are only used to display scores. Also, the number of dart games that may be played on electronic dart game machines is limited. Thus, a need exists for an electronic dart game machine that takes greater advantage of the visual capabilities of the video/graphical display controlled by the CPU. Additionally, a need exists for a new and exciting dart game that may be played on an electronic dart game machine.

BRIEF SUMMARY OF THE INVENTION

A system for an electronic dart golf game on an electronic dart game machine has been developed. Embodiments of the present invention include at least one electronic dart board having distinct scoring segments, a CPU electrically connected to at least one electronic dart board, a video display electrically connected to the CPU, and a memory, which stores a plurality of virtual golf courses, electrically connected to the CPU. Each electronic dart board is a standard, regulation electronic dart board having a plurality of distinct scoring segments that are configured to receive darts. The CPU detects dart hits or contacts at the distinct scoring segments The CPU displays game mode graphics on the video display. The game mode graphics include a golf course hole graphic having a virtual ball and a hole, and a power control or meter having a moving element, such as an oscillating bar. The CPU correlates an instantaneous movement (or oscillation) of said oscillating or otherwise cyclical element at an instant when a dart initially hits or contacts a distinct scoring segment with a movement of the virtual ball on the golf course hole graphic. The CPU also correlates a spatial relationship between a point where the dart contacts the distinct scoring segment and at least one of a target distinct scoring segment and target, distinct scoring area with flight path characteristics, such as slicing and hooking, of the virtual ball.

Embodiments of the present invention may be played by a plurality of players playing at a plurality of electronic dart game machines. The electronic dart game machines may be networked together to allow for additional players at additional locations.

A method of an electronic dart golf game has also been developed. The method includes the steps of storing a plurality of virtual golf courses in the memory of an electronic dart game machine having a video display and an electronic dart board; displaying or showing a power indicator having a moving indicator, such as an oscillating bar, on the video display; moving the moving indicator so that a player may anticipate when to throw a dart toward the electronic dart board; displaying a course hole graphic and a virtual ball on the video display; contacting a distinct scoring segment on an electronic dart board with a thrown dart; and correlating the contacting step with a movement of the virtual golf ball over the course hole graphic shown on the video display.

Figure 1:
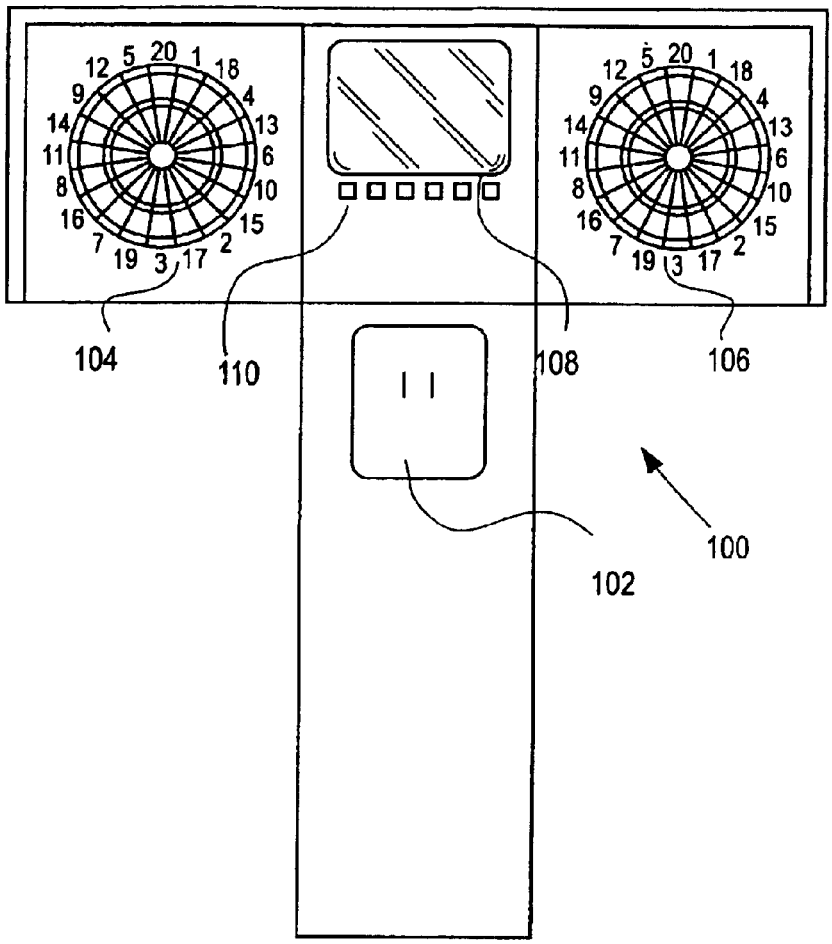
FIG. 1 illustrates an electronic dart game machine according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments of the present invention. It should be understood, however, that the present invention is not limited to these embodiments nor to the arrangements and instrumentalities shown in the attached drawings.

DETAILED DESCRIPTION OF THE DRAWINGS

FIG. 1 illustrates an electronic dart game machine 100 according to an embodiment of the present invention. The electronic dart game machine 100 includes a player interface 102, a first electronic dart board 104, a second electronic dart board 106, a video display 108, interface keys 110, and a CPU (not shown in FIG. 1). The interface keys 110 may include selection keys and player change buttons. Alternatively, the electronic dart game machine 100 may include only one electronic dart board. Also, alternatively, the electronic dart game machine 100 may include more than two electronic dart boards.

Players may input game selection information and other parameters through the interface keys 110, the player interface 102 and/or a touchscreen included on the video display 108. The video display 108 may be a cathode ray tube (CRT) based display, a liquid crystal display (LCD), a dense grid of light emitting diodes (LEDs) or the like. The display 108 may present players with various game selection choices, which may be activated by pressing a corresponding interface key 110, a button on the player interface 102 and/or an appropriate location on the touchscreen of the video display 108.

The electronic dart game machine 100 may also provide video output connectors, which may provide standard connections to VGA, NTSC or S-video displays. The video display may then be mounted in a location remote from the electronic dart game machine 100.

Each electronic dart board 104 and 106 may include, for example, a set of switches (which may be magnetic, mechanical or optical) associated with each segment (such as double 20, triple 20 and bullseye) for each target value on the electronic dart board 104 or 106. When a dart hits or contacts a segment, such as triple 20, a switch associated with the segment closes. By scanning the set of switches with a general purpose bus, the CPU included within the electronic dart game machine 100 may determine the switch that was closed. Consequently, the CPU may determine the associated target value.

Figure 2:
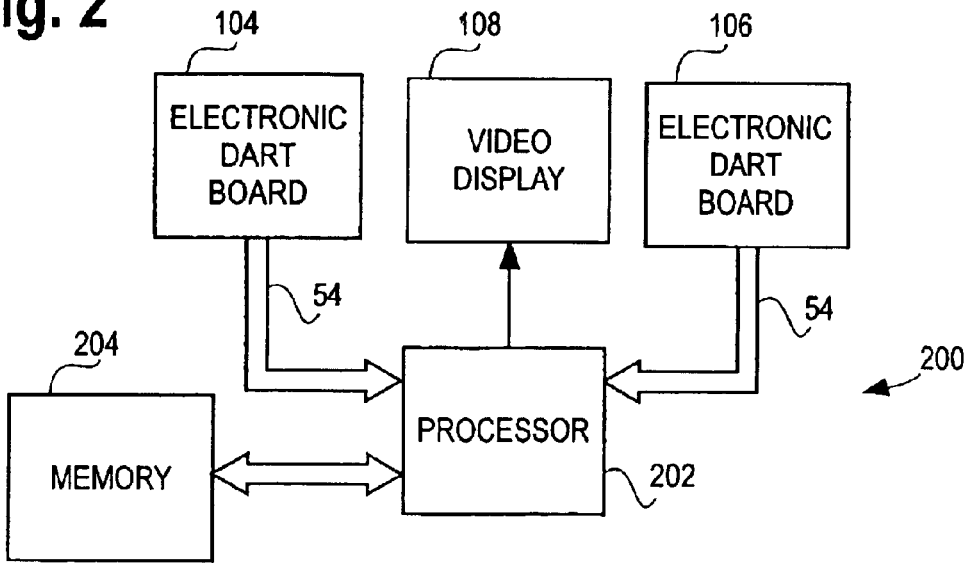
FIG. 2 is a schematic diagram of a hardware configuration of the electronic dart game machine according to an embodiment of the present invention.

FIG. 2 is a schematic diagram of a hardware configuration 200 of the electronic dart game machine 100 according to an embodiment of the present invention. The hardware configuration 200 includes the video display 108, the first electronic dart board 104, the second electronic dart board 106, the CPU 202 and a memory 204. The CPU 202 electronically connects to the first and second dart boards 104 and 106, the video display 108 and the memory 204. The memory 204 provides the CPU 202 with memory resources and may include banks of RAM, ROM, flash memory, EEPROM, magnetic memory or the like. The CPU 202 may be a single processor unit, or may be implemented with discrete logic, programmable logic, or a combination of a high-level processor core and discrete logic. The CPU 202 includes game set-up and game mode information. That is, the CPU 202 controls the set-up and game play of the electronic dart golf game. For example, the CPU 202 may store a plurality of electronic dart golf courses, each having a plurality of holes, within the memory 204. After each hole is completed, the CPU 202 retrieves information for the next hole and displays the new hole on the video display 108. For example, after a player(s) is finished with the first hole, the CPU 202 keeps track of, and displays, the player(s)' scoring for that hole and moves on to the second hole.

Figure 3:
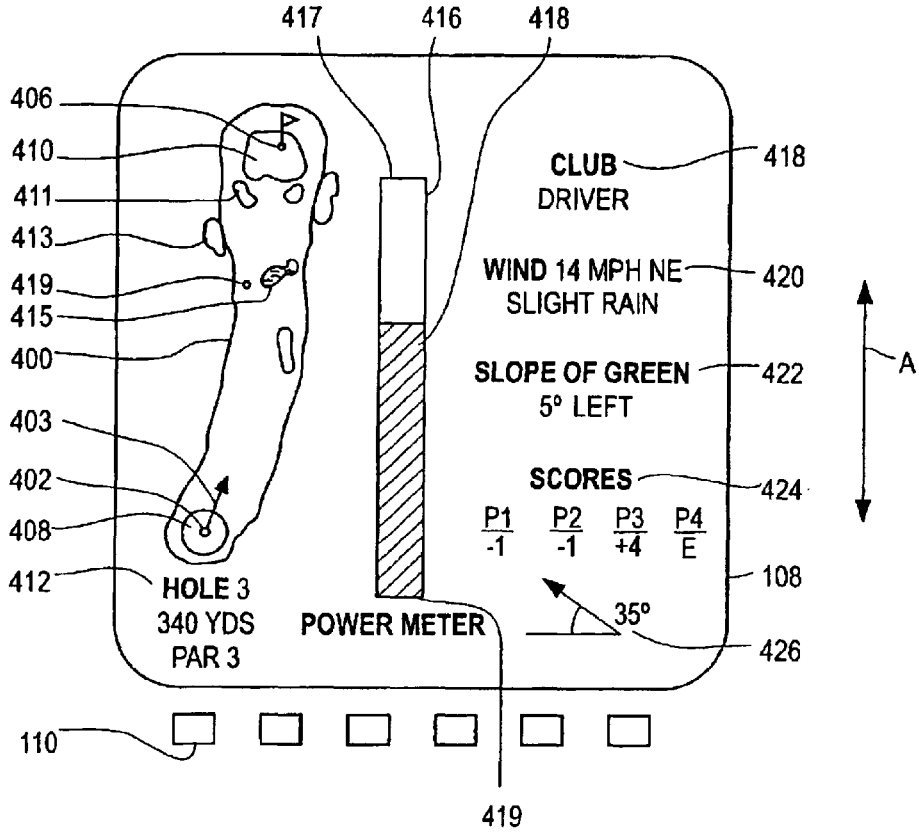
FIG. 3 illustrates a video display during a dart golf game mode, according to an embodiment of the present invention.

FIG. 3 illustrates the video display 108 during a dart golf game mode, according to an embodiment of the present invention. During game mode of the dart golf game, the CPU 202 displays game mode graphics on the video display 108. The game mode graphics include course hole graphic 400, hole information 412; power control 414, club selection graphic 418, environmental information 420 (such as wind and weather information), green conditions 422, player scores 424, and angle of trajectory 426.

The course hole graphic 400 includes a virtual ball 402 (one for each player), swing direction 403, hole 406, tee 408 and green 410. The course hole graphic 400 may also include graphics representing sand traps 411, trees 413, water hazards 415 (penalty stroke assessed if virtual ball 402 lands in a water hazard 415), virtual ball lie (e.g., "on the fairway," "in the rough," etc.) and other features of a golf course. The swing direction 403 may be selected through the interface keys 110, a button on the player interface 102 and/or an appropriate location on the touchscreen of the video display 108. For example, the player may touch an interface key 110, an appropriate location on the touchscreen of the video display 108 or a button on the player interface 102, which corresponds to swing direction, to rotate the swing direction 403 through 360 degrees. Alternatively, the swing direction 403 may be determined by the CPU 202. The hole information 412 includes the number of the hole being played (for example, hole 3), the virtual length from the tee 408 to the hole 406, and par for the hole. Additionally, the hole information 412 may also include a virtual distance from the virtual ball 402 to the hole 406. Also, the course hole graphic 400 may also include ball locations of additional players playing the electronic dart golf game.

The club selection graphic 418 includes the virtual club being used by a player. For example, a driver may be chosen among a plurality of virtual clubs. A graphic showing the plurality of virtual clubs may also be included on the video display during game play mode. A player may select a club through the interface keys 110, a button on the player interface 102 and/or an appropriate location on the touchscreen of the video display 108. For example, if the video display 108 is a touchscreen display 108, the player may touch the club selection graphic 418 to change clubs. The length, or height, of the power control 414 may correspond to the type of club selected. For example, the height of the power control 414 may be at its maximum when the driver is selected. If, however, a player selects a 3 Iron, the power control 414 may be shorter than the power control 414 for the driver.

Alternatively, club selection may not be used. Rather, the power control 414 may be aligned with the distance between the virtual ball 402 and the hole 406 such that distinct scoring segments, such as triple 20 segment 522 (shown below with respect to FIG. 7), may be designated as the prime or otherwise optimal shot to the hole 406. That is, the CPU 202 may randomly or systematically choose a distinct scoring segment, such as triple 20 segment 522 (and, perhaps, change the scoring segment after each dart throw) and display the particular scoring segment on the video display 108. Then, the player may attempt to contact the distinct scoring segment for an optimal shot to the hole 406. The virtual ball may land further from the hole 406 depending on the spatial distance between the dart 500 and the prime shot scoring segment (when the dart 500 contacts the electronic dart board 104). That is, the CPU 202 correlates the spatial distance with a movement, or "flight," of the virtual ball 402 over the course hole graphic 400.

The environmental information 420 (such as wind and weather information) and the green conditions 422 may be randomly or systematically determined by the CPU 202. The player may compensate for the environmental information 420 and the green conditions 422 when throwing a dart. That is, a player may wish to slice or hook a ball depending on the wind conditions shown by the environmental information 420. Further, while on the green 410, a player may determine that a straight shot is less than desirable depending on the slope of the green displayed by the green conditions 422.

The player scores 424 may be shown on the video display 108 at all times throughout game play. Alternatively, the player scores 424 may be shown after a hole is completed, such as when the CPU 202 transitions from one hole to a second hole. Further, between holes, a traditional-looking golf scorecard may be shown on the video display 108. The scorecard may show individual scores and denote bogies, pars, birdies, eagles, etc.

A player may also adjust the angle of trajectory 426 of the virtual ball 402. The angle of trajectory 426 may be adjusted through the interface keys 110, a button on the player interface 102 and/or an appropriate location on the touchscreen of the video display 108. Alternatively, the angle of trajectory 426 may be determined through the contact of the dart with the electronic dart board 104 or 106.

Figure 4:
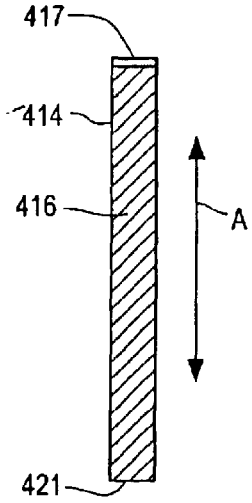
FIG. 4 illustrates a power control at full power, according to an embodiment of the present invention.
Figure 5:
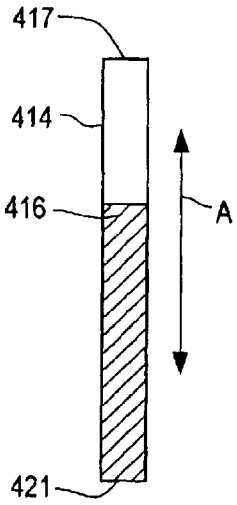
FIG. 5 illustrates the power control at approximately half power, according to an embodiment of the present invention.
Figure 6:
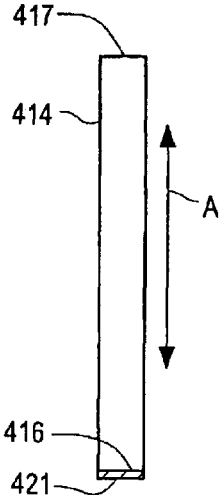
FIG. 6 illustrates the power control at minimal power, according to an embodiment of the present invention.

The power control 414 (or power meter) includes a base 421, a tip 417 and an oscillating indicator 416, which oscillates from-base 421 to tip 417 (and from tip 417 to base 421) in the direction of line A. Alternatively, instead of oscillating, the indicator may be a cyclical indicator that cycles from minimum power to medium power to maximum power to minimum power. The power control 414 may be linear, circular, or any other shape in which an inner member, such as the oscillating indicator 416, may be shown to oscillate, fluctuate, cycle, move, etc. FIG. 4 illustrates the power control 414 at full power, according to an embodiment of the present invention. FIG. 5 illustrates the power control 414 at approximately half power, according to an embodiment of the present invention. FIG. 6 illustrates the power control 414 at minimal power, according to an embodiment of the present invention. The oscillation of the oscillating indicator 416 may be programmed to oscillate at a constant speed for all clubs.

Alternatively, the oscillation of the oscillating indicator 416 may vary depending on the club selected. For example, if a driver is selected, the oscillating indicator 416 may oscillate faster than if a 5 iron is selected. Also, alternatively, the rate of oscillation of the oscillating indicator 416 may depend on the ability of the player. That is, during a game set-up mode, a player may choose between beginner, average and above average ability speeds for the oscillating indicator 416. Optionally, depending on a particular player's handicap, which may be input into the electronic dart game machine 100 during the game set-up mode or through a networked computer, modem and/or player card, the oscillating indicator 416 may oscillate faster for a player with a low handicap as opposed to a player with a high handicap.

The oscillating indicator 416 may stop, or become fixed, when a dart hits a relevant target segment, such as a target distinct scoring segment, on a dart board 104 or 106, in order to show the player the amount of swing power. That is, the CPU 202 may lock the oscillating indicator 416 into position when dart contact is detected with the dart board 104 or 106. The oscillating indicator 416 may begin oscillating after a predetermined time, or when an interface key 110 is engaged. Alternatively, the oscillating indicator 416 may continue to oscillate after dart contact is detected.

For example, a player may throw a dart. When the dart hits the dart board 104 or 106, the CPU 202 detects the contact and may stop the oscillation of the oscillating indicator 416 at the point in time when the dart hits the dart board 104. That is, the CPU 202 registers the instantaneous oscillation of the oscillating indicator 416 at the instant in time when the dart contacts the electronic dart board 104. Whether the oscillating indicator 416 stops or continues to oscillate or otherwise move, the CPU 202 correlates the height or length of the oscillating indicator 416, as of the time the dart contacts the electronic dart board 104 or 106, with a distance on the course hole graphic 400. Consequently, the virtual ball 402 travels a distance over the course hole graphic 400 that corresponds to the position of the oscillating indicator 416 as of the time the dart contacted the target distinct scoring segment on the electronic dart board 104 or 106. Then, after a predetermined period of time, the oscillating indicator 416 may begin to oscillate again until the next dart makes contact with the dart board 104 or 106 (if the oscillating indicator 416 stopped upon dart contact with the electronic dart board 104 or 106). After a player has thrown all of the darts (for example, three darts), the player may press a player change button, for example, one of the interface keys 110, on the electronic dart game machine 100 to change players.

A player may throw three darts in succession during game play mode. After the third dart is thrown, the CPU 202 may send a signal to the video display 108 prompting a player change. The dart golf game may proceed according to established rules of golf. That is, after the first player throws a dart, the second player throws a dart. After all players have thrown a dart (and consequently moved their respective virtual balls 402 on the course hole graphic 400), the player whose virtual ball 402 is furthest from the hole 406 gets to shoot next. Also, upon completion of a hole, the player with the lowest score for the completed hole gets to throw first for the next hole. In other words, the player with the lowest score for a previous hole has "honors" for the next hole.

Figure 7:
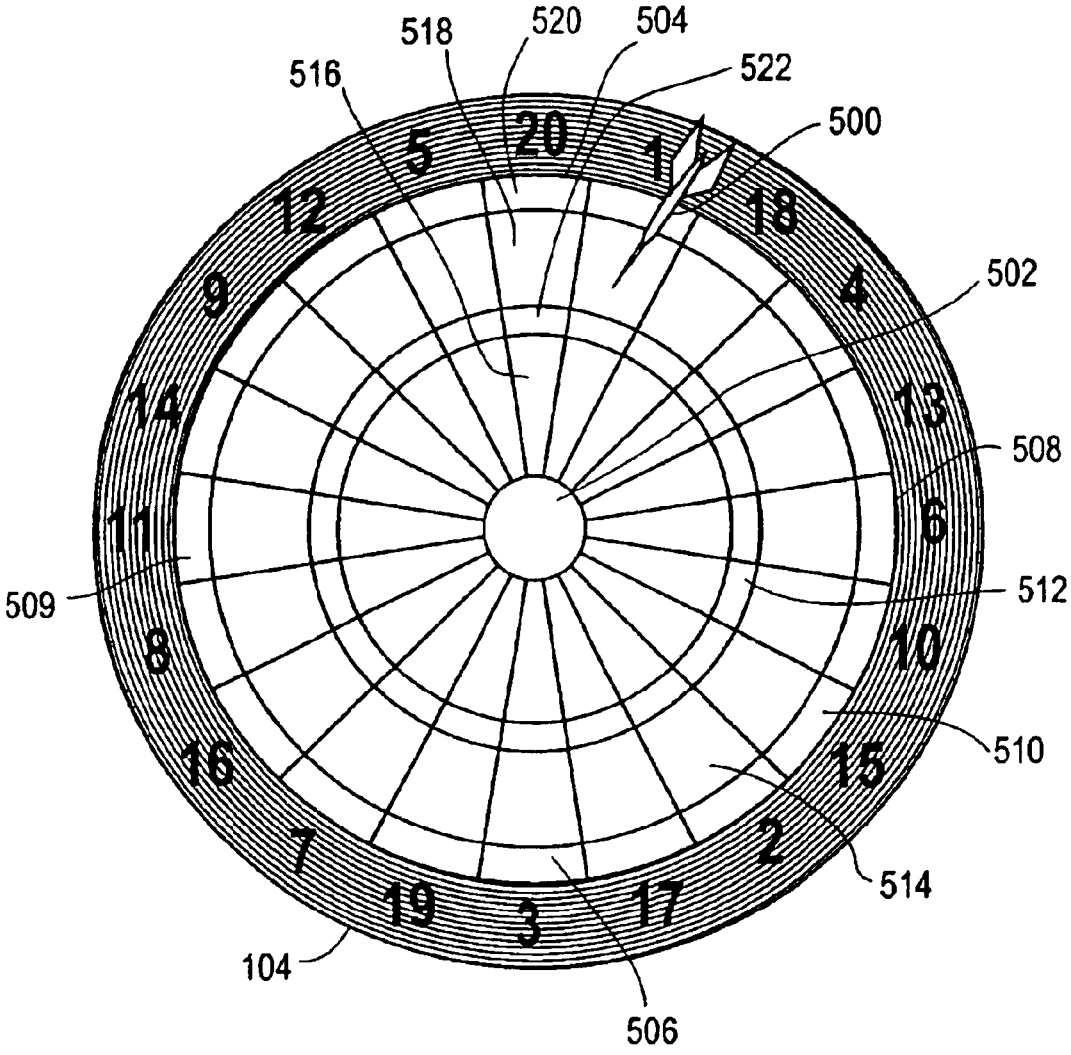
FIG. 7 illustrates an electronic dart board formed in accordance with an embodiment of the present invention.

FIG. 7 illustrates an electronic dart board 104 (which is the same as 106) formed in accordance with an embodiment of the present invention. The electronic dart board 104 includes a top portion 504, a bottom portion 506, a right portion 508 and a left portion 509. Additionally, the electronic dart board 104 includes a double ring 510, a triple ring 512, single segments 514 and a bullseye 502. As shown in FIGS. 1 and 7, the electronic dart board 104 (or 106) is of a standard configuration. That is, the playing surface of the electronic dart board 104 (or 106) is configured as a typical regulation dart board. Darts, such as dart 500, are thrown at, and stick in, the electronic dart board 104. Each numbered portion of the electronic dart board 104 includes distinct scoring segments. For example, numbered portion 20 of the electronic dart board 104 includes a lower single 20 segment 516, a triple 20 segment 504, an upper single 20 segment 518 and a double 20 segment 520.

Each numbered portion of the electronic dart board 104 (or 106) may correspond to a particular virtual club. The electronic dart game machine 100 may include a chart illustrating the relationship between virtual clubs and distinct scoring segments. For example, numbered portion 20 may correspond to a driver. Thus, numbered portion 20 is the target distinct scoring area for the driver. If a player throws a dart that connects with another numbered portion, such as numbered portion 18, when the chosen club is a driver, the player may be penalized a "stroke," or dart throw. Alternatively, the player may not be given the option to choose a club; rather, dart contact with a particular distinct scoring segment may determine which club is used. For example, if a player throws a dart that contacts numbered portion 20 on the electronic dart board 104, the virtual ball 402 may be hit with a driver. If, however, the dart contacts the numbered portion 5, the virtual ball 402 may be hit with a 5 Iron.

Alternatively, if the player is given a club selection choice before a dart is thrown, once a club is selected, the entire dart board 104 may be used to determine the flight of the virtual ball 402. That is, a player may only be required to make contact with any distinct scoring segment of the electronic dart board 104. The distance between the point of contact of the dart 500 with a target distinct scoring segment, such as a bullseye 502, on the electronic dart board 104 may determine the distance between the virtual ball 402 and the hole 406. For example, if the bullseye 502 is the target (communicated to the player by way of the video display 108), a dart 500 that contacts the electronic dart board 104 at lower single 20 segment 516, for example, may result in the virtual ball 402 being closer to the hole 406 than if the dart 500 contacted the upper single 20 segment 518.

Alternatively, the CPU 202 may segregate the electronic dart board 104 into a plurality of sections. That is, instead of a player throwing a dart toward target distinct scoring segments, such as triple 20, the player may set the game up such that a group of distinct scoring segments become a distinct scoring area (such as an entire numbered portion of the electronic dart board 104, or even the entire electronic dart board 104). Each section, or area, may correspond to a different club. For example, the radial portion from numbered portion 13 to numbered portion 20 may correspond to a first club, while the radial portion from numbered portion 5 to numbered portion 11 may correspond to a second club. The video display may display which areas of the electronic dart board 104 correspond to different clubs. If the electronic dart board 104 is segregated into four club sections, the player may choose which four clubs are included within the sections. Alternatively, the CPU 202 may automatically choose the four most applicable virtual clubs with respect to the distance from the virtual ball 402 to the hole 406. That is, the player or the CPU 202 may choose a range of virtual clubs that may correspond to sections of the electronic dart board 104.

During game set-up mode, a player may choose various types of dart board/club relationships. For example, a player may opt to choose a virtual club before a throw and have the entire electronic dart board 104 act as a unified segment for the particular club. Optionally, the player may choose that each numbered portion corresponds to a different club; or that groups of numbered portions correspond to different clubs.

Slice and hook shots may also be determined through the contact of the dart 500 with the electronic dart board 104. For example, if the target distinct scoring segment is triple 20 segment 520, the lower single segment, such as lower single 20 segment 516, may hook the virtual ball 402, while the upper single segment, such as upper single segment 518, may slice the virtual ball 402. The triple segment, such as triple 20 segment 522, may be a straight shot. Additionally, the further a dart is from a target distinct scoring segment, such as triple 20 segment 522, the more the virtual ball 402 may slice or hook. For example, a dart that contacts lower single 20 segment 516 will hook less the closer it is to the triple 20 segment 522. Conversely, a dart that contacts lower single 20 segment 516 will hook more the closer it is to the bullseye 502. Similarly, a dart that contacts upper single 20 segment 516 will slice more the farther the dart is from the triple 20 segment 516.

Alternatively, the entire electronic dart board 104 may represent the virtual ball while the dart 500 may represent the contact point between the virtual club chosen and the virtual ball 402. For example, a thrown dart 500 that contacts the electronic dart board 104 at the bullseye 502 may result in a perfectly centered and straight shot. Dart contact below the bullseye 502 toward the bottom portion 506 of the electronic dart board 506 may result in hitting under, or putting backspin on, the virtual ball 402 with the virtual club. Conversely, dart contact above the bullseye 502 toward the top portion 504 of the electronic dart board 506 may result in hitting over, or putting topspin on, the virtual ball 402 with the virtual club. Also, hitting toward the left portion 509 or the right portion 508 may result in slice and hook shots. The slice, hook, backspin, or topspin of the virtual ball 402 may increase with increased distance between the dart 500 and the bullseye 502 (upon the dart 500 contacting the electronic dart board 104). Optionally, the angle of trajectory of the virtual ball may be determined by the distance from the bullseye 502. That is, the angle of trajectory may increase with increased distance between the dart 500 and the bullseye 502 (upon the dart 500 contacting the electronic dart board 104). A player may desire to compensate for the environmental conditions 420 shown on the video display 108 by throwing a dart 500 away from the target distinct scoring segment in order to slice, hook, or otherwise hitting a non-straight shot.

Referring again to FIG. 3, the length of the power control 414 may correspond to the maximum distance a virtual ball 402 may travel. For example, before a player throws a dart, the base 421 of the power control 414 may be aligned with the current location of the virtual ball 402, while the tip 417 of the power control 414 may align with a position on the course hole graphic 400 to which the virtual ball 402 may travel if a dart hits an appropriate target segment when the power control 414 is at full power. In other words, the height of the oscillating indicator 416 may directly correspond to the distance the virtual ball 402 may travel on the course hole graphic 400 toward the hole 406. For example, as shown in FIG. 3, if a player contacts the relevant target segment of the electronic dart board 104 (or 106) when the oscillating indicator 416 is at the position shown in FIG. 3, the virtual ball may travel to the spot 419. Thus, the height of the oscillating indicator 416 as of the time a dart 500 contacts the electronic dart board 104 (or 106) may be a visual indicator of the distance the virtual ball 402 may travel over the course hole graphic 400.

Alternatively, the power control 414 may not directly correspond to the distance the virtual ball 402 may travel over the course hole graphic 400. That is, the height of the power control 414 may remain constant for all clubs. However, a power control 414 at maximum power for a driver, for example, will result in a virtual ball 402 traveling a longer distance over the course hole graphic 400 than that of a power control 414 at maximum power for a 3 Wood. In other words, the alignment of the power control 414 with the course hole graphic 400 may not provide a visual guide as to how far the virtual ball 402 may travel over the course hole graphic 400. Instead, the player may have to intuitively estimate how far the virtual ball 402 will travel depending on the length of the oscillating indicator 416.

Figure 8:
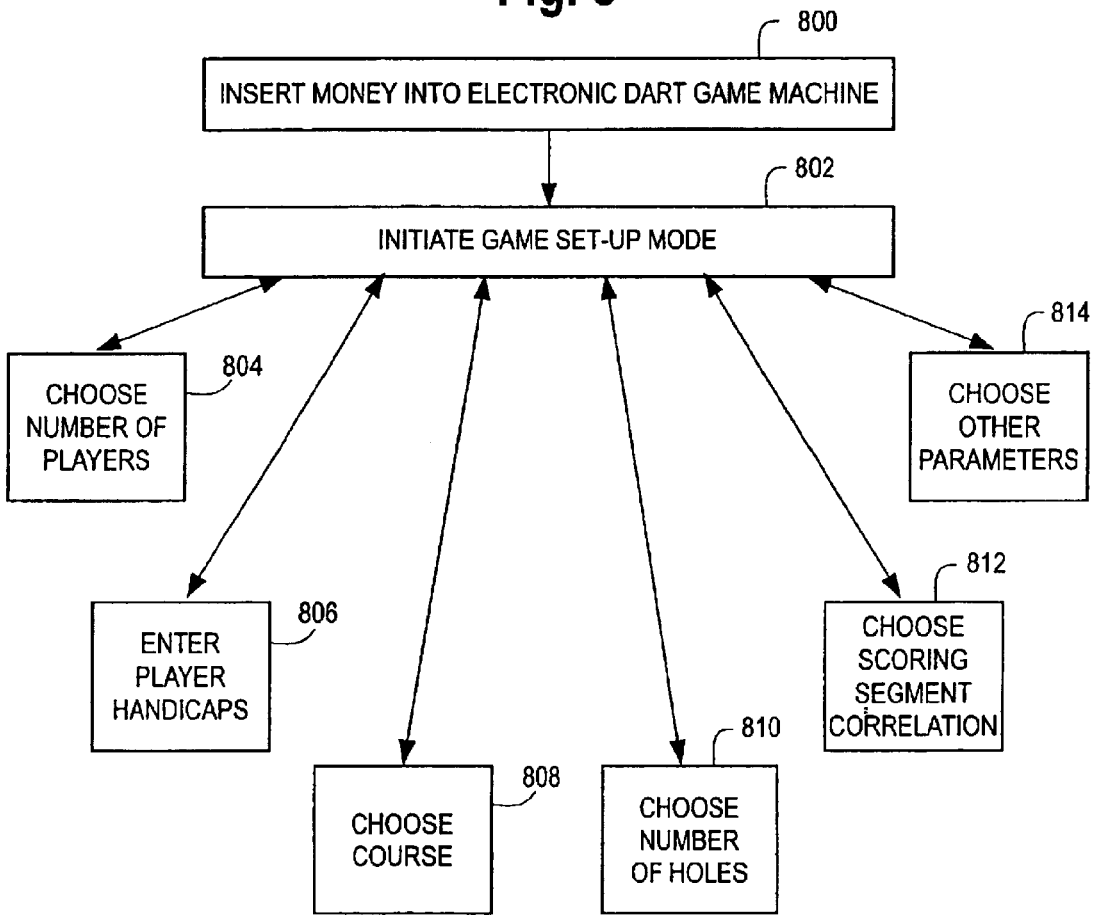
FIG. 8 is a flow chart of an operation of an electronic dart golf game during game set-up mode, according to an embodiment of the present invention.

FIG. 8 is a flow chart of an operation of an electronic dart golf game during game set-up mode, according to an embodiment of the present invention. The CPU 202 executes instructions stored in the memory 204 which correspond to certain steps illustrated in FIG. 8. At 800, a player inserts money into the electronic dart game machine 100. The electronic dart machine 100 may be in an attract mode before money is inserted into the electronic dart machine 100. That is, the instructions may start an attract mode periodically which illustrates the features of the game and how it is played. Next, at 802, the CPU 202 detects the insertion of money into the electronic dart game machine 100 and initiates game set-up mode. Game set-up mode includes setting up various parameters and ground rules of the electronic dart golf game. At 804, a player chooses the number of players. At 806, players may enter their respective handicaps. At 808, a player chooses a particular course from a library of courses stored in the memory. At 810, the player chooses the number of holes that the player would like to play. If more money is needed to play the number of holes the player chose, the CPU 202 may alert the player, through the video display 108, that more money needs to be inserted. At 812, the player may choose the scoring segment/virtual club relationship. For example, the player may decide that distinct scoring segments of numbered portions of the electronic dart board 104 represent different virtual clubs; or that the entire electronic dart board 104, or entire numbered portions, such as single, double, and triple distinct segments of a numbered portion of a dart board, may be target segments for straight shots. At 814, the player may choose among various other parameters. For example, the player may choose auto-club selection; auto optimal angle of trajectory, environmental conditions, etc.

Figure 9:
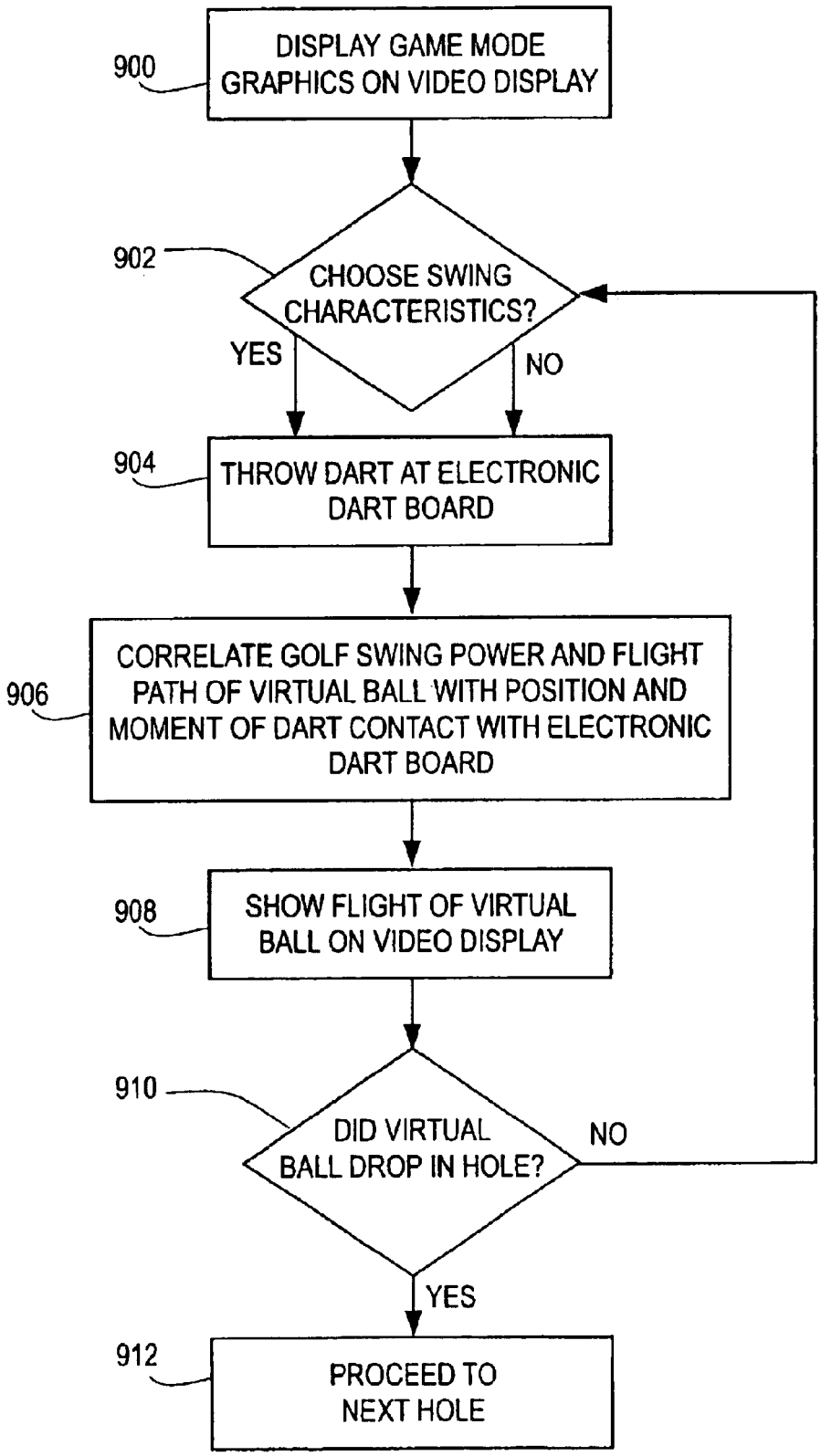
FIG. 9 is a flow chart of an operation of an electronic dart golf game during game play mode, according to an embodiment of the present invention.

FIG. 9 is a flow chart of an operation of an electronic dart golf game during game play mode, according to an embodiment of the present invention. The CPU 202 executes instructions stored in the memory 204 which correspond to certain steps illustrated in FIG. 9. At 900, the CPU 202 displays game mode graphics on the video display 108, after game set-up. The game mode graphics may include the course hole graphic 400, hole information 412, power control 414, club selection graphic 418, environmental information 420 (such as wind and weather information), green conditions 422, player scores 424, and angle of trajectory 426. At 902, the player may choose various swing characteristics, such as angle of trajectory and direction of swing, depending on whether, during game set-up, the player opted to choose these characteristics before throwing a dart. If these characteristics may be chosen before a dart is thrown, the player chooses them. If not, these characteristics may be determined based on the throw of the dart.

At 904, the player throws a dart at the electronic dart board 104 (or 106). Next, at 906, the CPU 202 correlates the golf swing power and flight path of the virtual ball 402 with the position of the dart at the moment the dart contacted the electronic dart board 104 (or 106). That is, the player must watch the oscillating indicator 416 oscillate on the power control 414 and throw the dart such that the dart contacts the electronic dart board 104 (or 106) when the power control 414 is at maximum power, or at a particular desired power position. The CPU 202 correlates the distance that the virtual ball travels with the position of the oscillating indicator 416 at the moment the dart contacts the electronic dart board 104 (or 106). Additionally, the CPU 202 correlates the flight path of the virtual ball based on the spatial distance between the point of dart contact and the target segment. That is, if triple 20 is the target corresponding to a straight shot, the distance between the point of dart contact on the electronic dart board 104 or 106 and the triple 20 determines the slice, hook, and/or topspin or backspin of the virtual ball.

At 908, the CPU 202 shows the flight of the virtual ball on the video display 108. If, at step 910, the virtual ball converges on, or "drops in," the hole 406, the particular player is done with the particular hole. The player then waits until other players are finished with the particular hole. If the virtual ball does not drop into the hole 406, the virtual ball is then shown at its new position on the course hole graphic 400, at which point the process repeats until the ball is in the hole 406. When all players are finished with a particular hole, the players proceed to the next hole. Player scores may be displayed on the video display throughout game play, or may be displayed at transition points, such as after the completion of a hole.

Typical golf scoring rules may apply to the electronic dart golf game. For example, if a virtual ball 402 lands in a water hazard 415 or out of bounds, the player may be assessed a penalty stroke. Additionally, one or more players may play the electronic dart golf game. Also, additional electronic dart boards may be networked together such that multiple players at multiple electronic dart game machines may play. Also, speed electronic dart golf may be played. That is, the CPU may keep track of the time it takes a player to finish a round of electronic dart golf. Also, stroke limits may be used with each hole. For example, the CPU may limit the maximum number of dart throws per course hole to 6. After a player throws six darts without putting the virtual ball in the hole, the player moves on to the next hole. Also, the CPU may keep track of golf feats such as longest drive, longest putt, birdies, eagles, albatrosses, holes-in one, etc.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A system for a dart-based golf game that may be played by having one or more players throw darts at an electronic dart game machine including:

at least one electronic dart board having distinct scoring segments, said at least one electronic dart board being configured to have player-thrown darts contact said at least one electronic dart board;

a CPU electrically connected to said at least one electronic dart board, said CPU detecting dart contact with at least one of said distinct scoring segments of said at least one electronic dart board; and a video display electrically connected to said CPU, said CPU displaying game mode graphics on said video display, said game mode graphics including:

a golf course hole graphic having a virtual ball and a hole; and a power control having a moving element, said CPU correlating an instantaneous movement of said moving element, at an instant of said dart contact, with a movement of said virtual ball on said golf course hole graphic.

2. The system of claim 1 wherein said CPU correlates a spatial relationship between said dart contact and at least one of a target distinct scoring segment and target distinct scoring area with flight path characteristics of said virtual ball.

3. The system of claim 1 wherein said electronic dart board is configured as a standard dart board.

4. The system of claim 1 wherein said game mode graphics further include a club selection graphic, said club selection graphic displaying a virtual club.

5. The system of claim 1 wherein said game mode graphics further include environmental information, said environmental information displaying virtual wind and weather conditions.

6. The system of claim 1 wherein said game mode graphics further include green conditions, said green conditions displaying a slope of a virtual green.

7. The system of claim 1 wherein said game mode graphics further include hole information, said hole information including the number of a hole within the course, a distance from a tee to said hole, and a par indication.

8. The system of claim 1 further including a memory electrically connected to said CPU, said memory including at least one virtual golf course.

9. The system of claim 1 further including a memory electrically connected to said CPU, said memory including at least one of rules and instructions for game play.

10. The system of claim 1 wherein said at least one electronic dart board includes at least two electronic dart boards.

11. The system of claim 1 further including multiple electronic dart game machines networked to one another.

12. A method of a player thrown dart-based golf game playable by one or more players on an electronic dart game machine, said electronic dart game machine comprising at least one electronic dart board having distinct scoring segments, a CPU electrically connected to said at least one electronic dart board, and a video display electrically connected to said CPU, said method including:

displaying a course bole graphic and a virtual ball on the video display;

contacting a distinct scoring segment on said at least one electronic dart board with a thrown dart; and correlating said contacting step with a movement of the virtual golf ball over the course hole graphic shown on the video display.

13. The method of claim 12 wherein said displaying step further includes displaying a power control having a moving indicator; and moving the moving indicator so that the player may anticipate when to throw the dart toward the electronic dart board.

14. The method of claim 12 further including selecting it least one game parameter during a game set-up mode.

15. The method of claim 12 further including networking a plurality of electronic dart game machines together such that a plurality of players may play the dart-based golf game at a plurality of locations.

16. The method of claim 12 further including storing a plurality of virtual golf courses in a memory that is electrically connected to the CPU.

17. The method of claim 12 further including selecting at least one of club selection, angle of trajectory and swing direction before said contacting step.

18. The method of claim 12 wherein said correlating step includes correlating a spatial relationship between a point of dart contact and at least one of a target distinct scoring area and target distinct scoring segment with flight path characteristics of the virtual ball.

19. The method of claim 12 further including randomly selecting a target distinct scoring area before said contacting step.

20. The method of claim 12 further including systematically designating a target distinct scoring area for a given hole of a virtual golf course before said contacting step.

21. The method of claim 12 further including randomly selecting a target distinct scoring segment before said contacting step.

22. The method of claim 12 further including systematically designating a target distinct scoring segment for a given hole of a virtual golf course before said contacting step.

23. The method of claim 12 further including varying virtual environmental conditions for each hole of a virtual golf course.

24. A system for an electronic dart golf game that may be played by having one or more players throw darts at an electronic dart game machine including:

at least one electronic dart board having distinct scoring segments, said at least one electronic dart board being configured to have player thrown darts contact said at least one electronic dart board, said at least one electronic dart board configured as a regulation dart board;

a CPU electrically connected to said at least one electronic dart board, said CPU detecting dart contact with at least one of said distinct scoring segments of said at least one electronic dart board; and a video display electrically connected to said CPU, said CPU displaying game mode graphics on said video display, said game mode graphics including:

a golf course hole graphic having a virtual ball and a hole; and a power control having a moving element, said CPU correlating an instantaneous movement of said moving element, at an instant when a dart initially contacts a distinct scoring segment, with a movement of said virtual ball on said golf course hole graphic, and said CPU correlating a spatial relationship between a point where said dart contacts said distinct scoring segment and at least one of a target distinct scoring segment and target distinct scoring area with flight path characteristics of said virtual ball.

25. The system of claim 24 wherein said game mode graphics further include a club selection graphic, said club selection graphic displaying a virtual club.

26. The system of claim 24 wherein said game mode graphics further include environmental information, said environmental information displaying virtual wind and weather conditions.

27. The system of claim 24 wherein said game mode graphics further include green conditions, said green conditions displaying a slope of a virtual green.

28. The system of claim 24 wherein said game mode graphic further include hole information, said hole information including the number of a hole within the course, a distance from a tee to said hole, and a par indication.

29. The system of claim 24 farther including a memory electrically connected to said CPU, said memory including at least one virtual golf course.

30. The system of claim 24 further including a memory electrically connected to said CPU, said memory including at least one of rules and instructions for game play.

31. The system of claim 24 wherein said at least one electronic dart board includes at least two electronic dart boards.

32. The system of claim 24 further including multiple electronic dart game machines networked to one another.

33. A method of a player thrown dart-based golf game playable by one or more players on an electronic dart game machine, said electronic dart game machine comprising at least one electronic dart board having distinct scoring segments, a CPU electrically connected to said at least one electronic dart board, a memory that is electrically connected to the CPU, and a video display electrically connected to said CPU, said method including:

storing a plurality of virtual golf courses in the memory;

showing a power control having an oscillating indicator on the video display;

moving the oscillating indicator so that the player may anticipate when to throw a dart toward the electronic dart board;

displaying a course hole graphic and a virtual ball on the video display;

contacting a distinct scoring segment on an electronic dart board with the thrown dart; and correlating said contacting step with a movement of the virtual, golf ball over the course hole graphic shown on the video display.

34. The method of claim 33 further including selecting at least one game parameter during a game set-up mode.

35. The method of claim 33 further including networking a plurality of electronic dart game machines together such that a plurality of players may play the dart-based golf game at a plurality of locations.

36. The method of claim 33 further including selecting at least one of club selections, angle of trajectory and swing direction before said contacting stop.

37. The method of claim 33 wherein said correlating step includes correlating a spatial relationship between a point of dart contact and at least one of a target distinct scoring area and target distinct scoring segment with flight path characteristics of the virtual ball.

38. The method of claim 33 further including randomly selecting a target distinct scoring area before said contacting step.

39. The method of claim 33 further including systematically designating a target distinct scoring area for a given hole of a virtual golf course before said contacting stop.

40. The method of claim 33 further including randomly selecting a target distinct scoring segment before said contacting step.

41. The method of claim 33 further including systematically designating a target distinct scoring segment for a given hole of a virtual golf course before said contacting step.

42. The method of claim 33 further including varying virtual environmental conditions for each hole of a virtual golf course.

* * * * *